United States Patent [19]

Komamura et al.

[11] Patent Number: 4,770,981

[45] Date of Patent: Sep. 13, 1988

[54] HEAT-DEVELOPMENT-TYPE COLOR LIGHT-SENSITIVE MATERIAL

[75] Inventors: Tawara Komamura, Hachioji; Masaru Iwagaki, Hino; Toyoaki Masukawa, Hinode, all of Japan

[73] Assignee: Konishiroku Photo Industry Co., Ltd., Tokyo, Japan

[21] Appl. No.: 63,756

[22] Filed: Jun. 17, 1987

Related U.S. Application Data

[63] Continuation of Ser. No. 767,730, Aug. 20, 1985, abandoned.

[30] Foreign Application Priority Data

Aug. 21, 1984 [JP] Japan ..... 59-174592

[51] Int. Cl.[4] ..... G03C 7/00; G03C 7/26

[52] U.S. Cl. ..... 430/505; 430/203; 430/619; 430/620; 430/351; 430/964

[58] Field of Search ..... 430/505, 203, 619, 620, 430/351, 964

[56] References Cited

U.S. PATENT DOCUMENTS

| | | | |
|---|---|---|---|
| 4,426,441 | 1/1984 | Adin et al. | 430/619 |
| 4,430,415 | 2/1984 | Aono et al. | 430/619 |
| 4,478,929 | 10/1984 | Jones et al. | 430/217 |
| 4,500,626 | 2/1985 | Naito et al. | 430/203 |
| 4,507,380 | 3/1985 | Naito et al. | 430/619 |
| 4,550,071 | 10/1985 | Aono et al. | 430/619 |

FOREIGN PATENT DOCUMENTS

| | | |
|---|---|---|
| 0.076492 | 4/1983 | European Pat. Off. . |
| 0131161 | 1/1985 | European Pat. Off. . |

*Primary Examiner*—Won H. Louie

*Attorney, Agent, or Firm*—Finnegan, Henderson, Farabow, Garrett and Dunner

[57] ABSTRACT

There is provided a multi-layer heat-developement-type color light-sensitive material comprising a support having thereon a layer containing light-sensitive silver halide grains, an organic silver salt, a reducing agent, a yellow dye donator substance and a binder, e.g. gelatin, a layer containing light-sensitive silver halide grains, an organic silver salt, a reducing agent, a magenta dye donator substance and a binder, and a layer containing light-sensitive silver halide grains, an organic silver salt, a reducing agent, a cyan dye donator substance and a binder, the binder of the respective layers amounting in total to from 3 g to 10 g per $m^2$ of said support; preferably at least one layer of the light-sensitive material contains a heat solvent.

9 Claims, No Drawings

HEAT-DEVELOPMENT-TYPE COLOR LIGHT-SENSITIVE MATERIAL

This application is a continuation, of application Ser. No. 767,730, filed Aug. 20, 1985, abandoned.

BACKGROUND OF THE INVENTION

The present invention relates to a heat-development-type color light-sensitive material, and more particularly to a heat-development-type color light-sensitive material whose transfer image has a high maximum density with little fog and excellent color separability.

The color photographic process which uses a conventionally known light-sensitive silver halide is superior in the light-sensitivity, gradation, image preservability, etc., to different other color photographic processes, and has been most extensively used to date. The color photographic process, however, because wet process is applied to its processing including development, bleaching, fixing and washing, has many such disadvantageous problems that it takes time and costs much labor in the processing, its processing chemicals are possible to harm the human body and also possible to pollute the processing room and operator's body, and the disposal of its waste liquids is laborious and costly.

For this reason, development of a method for the formation of color images by dry process has been strongly demanded.

Heat-development-type black-and-white light-sensitive materials, whose development is effected by heating, are conventionally known and described in, for example, Japanese Patent Examined Publication Nos. 4921/1968 and 4924/1968 disclosing those light-sensitive materials comprising organic silver salts, silver halides and developing agents. Further there are also known a variety of heat-developable color light-sensitive materials developed on the basis of such heat-developable black-and-white light-sensitive materials.

For example, U.S. Pat. Nos. 3,531,286, 3,761,270 and 3,764,328, and Research Disclosure Nos. 15108, 15127, 12044 and 16479 describe those heat-developable light-sensitive materials containing photographic couplers and color developing agents; U.S. Pat. No. 3,180,731, and Research Disclosure Nos. 13443 and 14347 describe those which use leuco dyes; U.S. Pat. No. 4,235,957 and Research Disclosure Nos. 14433, 14448, 15227, 15776, 18137 and 19419 describe those which apply the silver dye bleach process; and U.S. Pat. Nos. 4,124,398, 4,124,387 and 4,123,273 describe methods for the heat bleaching of heat-developable light-sensitive materials.

These proposals relating to heat-developable color light-sensitive materials, however, are hardly capable or totally incapable of bleaching or fixing the simultaneously formed black-and-white silver image, or even if capable of bleaching or fixing, they require a wet processing or the like. Accordingly, these proposals hardly enable the formation of clear color images or require a troublesome post-treatment, and thus no favorable one is found among these proposals.

On the other hand, those color light-sensitive materials designed to give a color image by transferring the diffusible dye released by heat development are disclosed in Japanese Patent Publication Open to Public Inspection (hereinafter referred to as Japanese Patent O.P.I. Publication) Nos. 179840/1982 (corresponding to U.S. Pat. Nos. 4,463,079), 186744/1982 (U.S. Pat. Nos. 4,474,867), 198458/1982 (EP-66,282), 207250/1982 (EP-67,455), 40551/1983 (U.S. Pat. Nos. 4,430,415), and 58543/1983 (EP-76,482), and disclosed also in our Japanese Patent O.P.I. Publication Nos. 12431/1984 and 229649/1982. These proposals are such that a dye donator having a diffusible dye in the same molecule thereof releases the diffusible dye as a result of the heat-developing reaction of an organic silver salt, and the released dye is then transferred to the image receiving layer, whereby a color image can be obtained. In the present specification such color light-sensitive materials are called "dye-releasing-type" color light-sensitive materials.

Also on the other hand, the proposals described in our Japanese Patent O.P.I. Publication Nos. 124339/1984 and 159159/1984 are such that a colorless or light-color dye donator reacts with the oxidized product of a color developing agent produced as a result of the heat-developing reaction of an organic silver salt to thereby form a heat-diffusible dye, which is then transferred to the image-receiving layer, whereby a color image is obtained. Such color light-sensitive materials are herein called "dye-forming-type" color light-sensitive materials.

In order to obtain a multicolor image on the image-receiving layer by the diffusion transfer of dyes by heating without requiring a wet processing, the color light-sensitive material, whether it is of the dye-forming type or of the dye-releasing type, is considered advantageous to be of the multilayer construction similar to that of conventional color light-sensitive materials.

To take a printing light-sensitive material as an example of conventional color light-sensitive materials, in the case of a color photographic paper, usually in order from the bottom layer, a blue-sensitive layer containing an yellow coupler, a green-sensitive layer containing a magenta coupler, and a red-sensitive layer containing a cyan coupler are formed. And in the case of a diffusion transfer-type printing material, the bottom layer is a cyan dye-donating red-sensitive layer, then a magenta dye-donating green-sensitive layer, and then an yellow dye-donating blue-sensitive layer are provided in the described order. In addition, interlayers for the purpose of preventing the colors from mixing are provided between the layers, and in most cases an yellow filter layer is provided between the blue-sensitive layer and the green-sensitive layer.

Also in heat-development-type color light-sensitive materials, in order to effect full color reproductions, a multilayer construction similar to the above will be necessary. In the case of a heat-development-type color light-sensitive material, however, if the superposed multilayer construction is adopted, there arises a problem that the bottom layer's dye is not completely transferred to the image-receiving layer, causing a transfer trouble of the dye from the bottom layer.

At the same time the light-sensitive material has the disadvantages that, due to its undesirable multilayer effect, the fog of, particularly, the lower layer, i.e., the layer located further from the image-receiving layer, increases as compared to the case of a single layer one, and its color separability is inadequate. Thus, the improvement of these disadvantages has been strongly demanded.

SUMMARY OF THE INVENTION

It is therefore an object of the present invention to provide a multilayer heat-development-type color light-sensitive material which has a high maximum density, small fog, and excellent color separability.

It is another object of the present invention to provide a multilayer heat-development-type color light-sensitive material which is excellent in the diffusion transferability of the dye from the bottom layer.

The above objects of the present invention can be accomplished by the following heat-development-type color light-sensitive material: In a heat-development-type color light-sensitive material comprising a support having thereon a layer containing at least a light-sensitive silver halide, organic silver salt, reducing agent, yellow dye donator and binder, a layer containing at least a light-sensitive silver halide, organic silver salt, reducing agent, magenta dye donator and binder, and a layer containing at least a light-sensitive silver halide, organic silver salt, reducing agent, cyan dye donator and binder, the heat-development-type color light-sensitive material in which the total quantity of the binders of each layer is from 3 grams to 10 grams per $m^2$ of the support.

The multi-layer heat-development-type color light-sensitive material of the invention which comprises a hydrophilic binder in an amount of from 3 g to 10 g per $m^2$ of the support thereof is capable of producing a transfer image having not only a high density with a small fog but also excellent color separability, and further, by the incorporation of an appropriate amount of a heat solvent thereinto, becomes capable of producing an image excellent also in the transferability.

DETAILED DESCRIPTION OF THE INVENTION

The present invention will be illustrated further in detail below:

One of the characteristics of this invention is that the heat-development-type color light-sensitive material of this invention is of a multilayer construction as stated above, and the using total quantity of the binder of light-sensitive material is from 3 grams to 10 grams per sq. meter of the support.

That is, according to this invention, if the total quantity of the binder is smaller than the above quantity range, the quantities of the non-binder constituents retained by the binder, such as, for example, a silver halide, organic silver salt, reducing agent, dye donator, etc., become smaller than the required quantities, and as a result, any sufficient maximum density-having image becomes unable to be obtained, or otherwise, the retention of the above constituents by the binder becomes inadequate, thus sometimes causing an undesiarable diffusion (mainly of the dye donator) between the layers to make the resulting color turbid. If the quantity of the binder exceeds the above-mentioned range, the maximum density decreases, while the minimum density increases, which are undesirable phenomena.

Further, according to tho present invention, a hydrophilic binder is to be preferably used as such binder. As compared with a hydrophobic binder, in using such hydrophilic binders, the transfer efficiency of the dye is improved to increase the maximum density and no color turbidity is caused by a diffusion of the dye donator, etc., between the layers.

The term "hydrophilic" as the hydrophilic binder used herein implies being soluble in water or in a mixture of water with an organic solvent (a solvent arbitrarily miscible with water). Examples of the hydrophilic binder include gelatin, gelatin derivatives, cellulose derivatives, polysaccharides such as dextran, natural substances such as gum arabic, and the like. And examples of the particularly useful binders include polyvinyl acetals (preferably ones whose acetalation degree is less than 20%, such as polyvinyl butyral), polyacrylamides, polyvinylpyrolidones, ethyl cellulose, polyvinyl alcohols (preferably ones whose saponification degree is more than 75%). And, if necessary, two or more different ones of these binders may be mixed to be used.

The particularly preferred binder in this invention is a mixture binder of gelatin with one or more non-gelatin hydrophilic binders. The gelatin content of such a binder is preferably more than 20% by weight, and more preferably in the range of from 20 to 80% by weight, and the total amount of the gelatin should preferably fall under the range of from 0.6 to 5 g per $m^2$ of the support.

Those particularly suitable as the non-gelatin hydrophilic binder are polyvinyl-pyrolidones and polyvinyl alcohols.

In the present invention, gelatin is effective in retaining the dye donator in the layer during its development as well as in restraining fog, and the above effects are particularly significant when the gelatin content of the binder is more than 20% by weight, and the transferability of the dye becomes markedly satisfactory and the maximum density becomes high when the content is less than 80% by weight (preferably less than 60% by weight).

In this invention, if the quantity of the binder is increased, exceeding the limited range in this invention, the transferability of the dye is impaired and fog is increased, whereas if the quantity is reduced to be out of the range, the color separability becomes deteriorated.

Into each of the above-mentioned component layers of this invention is desirable to be incorporated a heat solvent for the purpose of increasing the developing rate, dye producing efficiency, transferability, etc.

The heat solvent used in this invention is a material that is solid, semi-solid or liquid at normal temperature and by being heated dissolves or fuses, or plasticizes the binder. The preferred examples of it include urea derivatives, amide derivatives, polyethylene glycols, polyhydric alcohols, and the like. These heat solvents may be used either alone or in combination. Of these heat solvents the preferred are ones capable of improving not only the transferability of the dye but also the developability and the releasability or formability of the dye. In addition, the heat solvent of this invention need not be of a melting point of less than the heat-developing temperature and is allowed to be liquid at normal temperature.

The preferred urea derivatives are those having the following Formula (1):

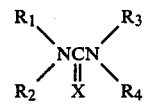

Formula (1)

wherein X is an oxygen atom or a sulfur atom; and $R_1$, $R_2$, $R_3$ and $R_4$ are allowed to be either the same as or different from each other and each is a hydrogen atom, a substituted or unsubstituted alkyl group (the $R_1$-$R_2$ and $R_3$-$R_4$ pairs each is allowed to combine to form a cyclic ring) having not more than 12 carbon atoms, or a substituted or unsubstituted aryl group having not more than 12 carbon atoms.

The preferred amide derivatives are those having the following Formula (2):

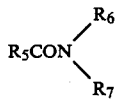

Formula (2)

wherein $R_5$ is a substituted or unsubstituted alkyl group having not more than 12 carbon atoms or a substituted or unsubstituted aryl group having not more than 12 carbon atoms; and $R_6$ and $R_7$ are allowed to be either the same as or different from each other and each is a hydrogen atom, a substituted or unsubstituted alkyl group having not more than 6 carbon atoms, a substituted or unsubstituted aryl group having not more than 12 carbon atoms or a substituted or unsubstituted acyl group having not more than 6 carbon atoms, the $R_5$ and $R_6$ being allowed to combine with each other to form a cyclic ring.

The preferred polyethylene glycols are those whose molecular weight is from 150 to 10,000.

The preferred polyhydric alcohols are those having not more than 12 carbon atoms in total, and are cyclic or chain alcohols having from 2 to 6 hydroxy groups (allowed to be substituted with a halogen atom, an alkoxy group, an acyl group, or the like).

Examples of the urea derivatives include urea, thiourea, 1,3-dimethyl-urea, 1,3-diethyl-urea, diethylene urea, 1,3-diisopropyl-urea, 1,3-dibutyl-urea, 1,1-dimethyl-urea, 1,3-dimethoxyethyl-urea, 1,3-dimethyl-thiourea, 1,3-dibutyl-thiourea, tetramethyl thiourea, phenyl urea, tetramethyl urea, tetraethyl urea, and the like.

Examples of the amide derivatives include acetamide, propionamide, n-butylamide, i-butylamide, benzamide, diacetamide, dimethylformamide, acetanilide, ethylacetamide acetate, 2-chloropropionamide, 3-chloropropionamide, phthalimide, succinic acid imide, N,N-dimethylacetamide, and the like.

Examples of the polyhydric alcohols include 1,5-pentanediol, 1,6-hexane-diol, dixylitol, pentaerythritol, 1,4-cyclohexane-diol, 2,2-dihydroxybenzophenone, 1,8-octane-diol, petriol (3-methylpentane-1,3,5-triol), and the like.

The heat solvent content in this invention is from 10% to 300% of the quantity of the binder, and preferably from 20% to 150%, and particularly preferably from 1 to 9 grams per $m^2$ of the support. The heat solvents to be used in this invention may be used alone or in combination of two or more of them.

The heat-development-type color light-sensitive material of this invention contains in the component layers thereof an yellow dye donator, a magenta dye donator and a cyan dye donator. These dye donators of this invention are ones that release dyes (coupling dye-releasing type) or form dyes (coupling dye-forming type) by the coupling reaction thereof with the oxidized product of a developing agent, and they also include those dye donators which themselves are reductive (reducing dye donator) or oxidative (oxidizing dye donator), which release dyes by the reduction reaction or oxidation reaction thereof.

The preferred dye donators of the above-mentioned coupling dye-releasing type are those compounds having the following Formula (3):

Formula (3) $Cp_1$-X-Dye wherein $Cp_1$ represents a coupler residue after the hydrogen atom in the active position is eliminated; X represents a divalent linkage group or merely a double bond; and Dye is a diffusible dye residue.

The coupler residue represented by the above $Cp_1$ includes those having the following Formulas (4) through (9):

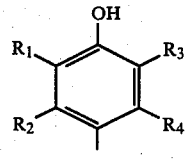

Formula (4)

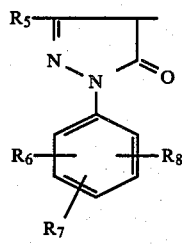

Formula (5)

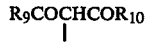

Formula (6)

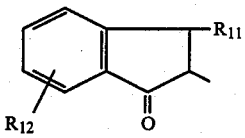

Formula (7)

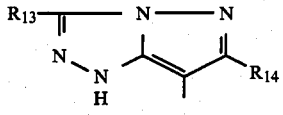

Formula (8)

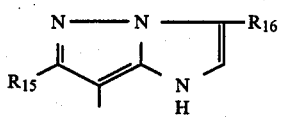

Formula (9)

wherein $R_1$, $R_2$, $R_3$ and $R_4$ each is a hydrogen atom, a halogen atom (preferably chlorine, bromine or iodine), a substituted or unsubstituted alkyl group (preferably an alkyl group having from 1 to 24 carbon atoms, such as methyl, ethyl, butyl, toctyl, n-dodecyl, n-pentadecyl, cyclohexyl, etc., or an aryl (such as a phenyl-substituted alkyl group including a benzyl or phenethyl group), a substituted or unsubstituted aryl group (such as phenyl, naphthyl, tolyl, mesityl), an aryl group (such as acetyl, tetradecanoyl, pivaloyl, substituted or unsubstituted benzoyl), an alkyloxycarbonyl group (such as methoxycarbonyl, benzyloxycarbonyl), an aryloxycarbonyl group (such as phenyloxy carbonyl, p-tolyloxycarbonyl, α-naphthoxycarbonyl), an alkylsulfonyl group (such as methylsulfonyl), an arylsulfonyl group (such as phenylsulfonyl), a carbamoyl group (such as a substituted or unsubstituted alkylcarbonyl group such as methylcarbamoyl, butylcarbamoyl, tetradecylcarbamoyl, N-methyl-N-dodecylcarbamoyl, etc., a substitutable phenoxyalkylcarbamoyl group such as 2,4-di-t-phenoxybutylcarbamoyl, a substituted or unsubstituted phenylcarbamoyl group such as 2-dodecyloxyphenylcarbamoyl, or the like), a substituted or unsubstituted acylamino group (such as acetamido, n-butylamido, i-propylamido, laurylamido, substitutable β-phenoxyethylamido, phenoxyacetamido, substituted or unsubstituted benzamido, methanesulfonamidoethylamido, β-methoxyethylamido), an alkoxy group (preferably an alkoxy group having from 1 to 18 carbon atoms, such as methoxy, ethoxy, octadecyloxy), a sulfamoyl group (such as methylsulfamoyl, n-dodecylsulfamoyl, a substituted or unsubstituted phenylsulfamoyl group such as dodecylphenylsulfamoyl), a sulfonylamino group (such as methylsulfonylamino, tolylsulfonylamino), or a hydroxyl group, provided the $R_1$ and $R_2$ are allowed to combine with each other to form a saturated or unsaturated 5- or 6-member cyclic ring; $R_5$ represents an alkyl group (preferably an alkyl group having from 1 to 24 carbon atoms, such as methyl, butyl, heptadecyl), an alkoxy group (preferably an alkoxy group having from 1 to 18 carbon atoms, such as methoxy, ethoxy, octadecyloxy), a substituted or unsubstituted arylamino group (such as anilino or anilino substituted with such a substituent as a halogen atom, an alkyl, amido or imido group, etc.), a substituted or unsubstituted alkylamido group (such as laurylamido, substitutable phenoxyacetamido, phenoxybutaneamido), a substituted or unsubstituted arylamido group (such as benzamido or benzamido substituted with such a substituent as a halogen atom, an alkyl, alkoxy or amido group), or the like; $R_6$, $R_7$ and $R_8$ each represents a hydrogen atom, a halogen atom (preferably chlorine, bromine or iodine), an alkyl group (preferably an alkyl group having from 1 to 2 carbon atoms, such as methyl or ethyl), a substituted or unsubstituted alkylamido group (such as laurylamido, a substitutable phenoxyalkylamido group such as an alkyl-substituted phenoxyacetamido), a substituted or unsubstituted arylamido group (such as benzoylamido), or the like; $R_9$ represents a substituted or unsubstituted alkyl group (preferably an alkyl group having from 1 to 8 carbon atoms, such as methyl, butyl, octyl), a substituted or unsubstituted aryl group (such as phenyl, tolyl, methoxyphenyl), or the like; $R_{10}$ is a substituted or unsubstituted arylamino group (such as anilino or anilino substituted with a halogen atom or an alkyl, alkoxy, alkylamido, arylamido or imido group); and $R_{11}$, $R_{12}$, $R_{13}$, $R_{14}$, $R_{15}$ and $R_{16}$ each is as defined in the foregoing $R_1$ and $R_2$; provided that at least one of the $R_1$ through $R_4$, at least one of the $R_5$ through $R_8$, at least one of the $R_9$ and $R_{10}$, at least one of the $R_{11}$ and $R_{12}$, at least one of the $R_{13}$ and $R_{14}$, and at least one of the $R_{15}$ and $R_{16}$, each is desirable to be a group substituted with a hydrophilic group or groups such as sulfo group, carboxy group, etc.

The divalent linkage group represented by the X includes

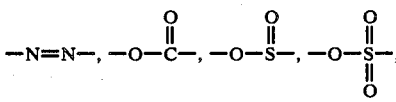

and the like.

And the dye residue represented by Dye includes azo-type, azomethine-type, indoaniline-type, anthraquinone-type dye residues, and of these dye residues those having a molecular weight of not more than 600 are preferred.

On the other hand, the preferred coupling dye-forming-type dye donators are those having the following Formula (10):

Formula (10) $Cp_2$-Y wherein $Cp_2$ represents a coupler residue after eliminating the hydrogen atom in the active position; and Y represents a group which can split off from the coupler during the coupling reaction and which has a group containing at least a hydrophilic group such as a sulfo or carboxy group or these groups, and particularly preferably a group or polymer-chain residue having a straight-chain or branched-chain alkyl group, whose total number of carbon atoms is not less than 8.

The coupler residue represented by $Cp_2$ includes, e.g., those having the following Formulas (11) through (15). The particularly preferred coupler residues are those whose molecular weight is not more than 400 and which are substituted with a hydrophilic group such as a sulfo or carboxy group.

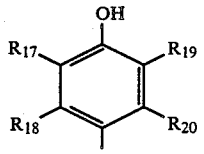

Formula (11)

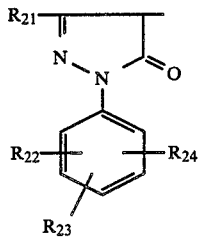

Formula (12)

$R_{25}COCHCOR_{26}$

Formula (13)

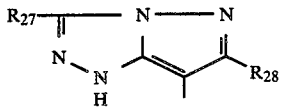

Formula (14)

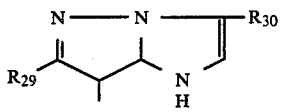

Formula (15)

wherein $R_{17}$, $R_{18}$, $R_{19}$ and $R_{20}$ are as defined in the $R_1$, $R_2$, $R_3$ and $R_4$ of the foregoing Formula (4); $R_{21}$ is as defined in the $R_5$ of Formula (5); $R_{22}$, $R_{23}$ and $R_{24}$ are as defined in the $R_6$, $R_7$ and $R_8$ of Formula (5); $R_{25}$ is as defined in the $R_9$ of Formula (6); $R_{26}$ is as defined in the $R_{10}$ of Formula (6); and $R_{27}$, $R_{28}$, $R_{29}$ and $R_{30}$ are as defined in the $R_1$ and $R_2$ of Formula (4).

The foregoing reducing dye donator includes those compounds having the following Formula (16):

Formula (16) Z-$SO_2$-Dye wherein Z is a reducing substrate that can be oxidized by an organic silver salt; and Dye is a dye residue. Examples of the dye donator of this type are described in, e.g., Japanese Patent O.P.I. Publication No. 179840/1982 (corresponding to U.S. Pat. No. 4,463,077).

The particularly preferred ones among these dye donators are those of the coupling dye-forming type.
The following are typical examples of the yellow dye donator:
Exemplified Compounds:
(Y-1)
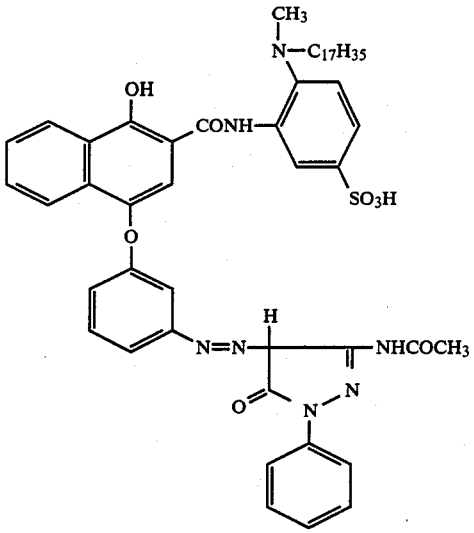
(Y-2)
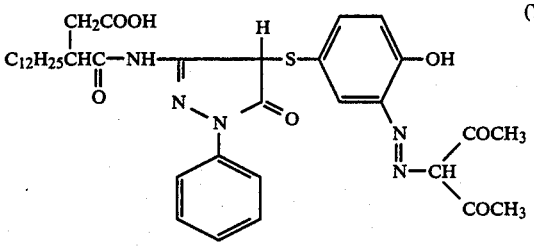
(Y-3)
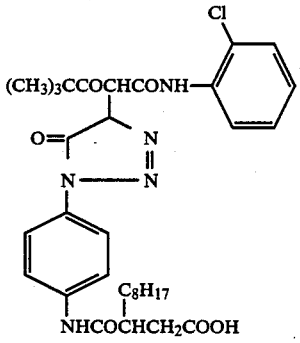
(Y-4)
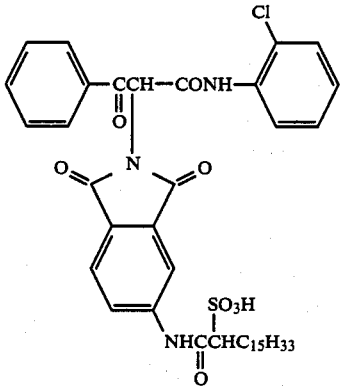
-continued
Exemplified Compounds:
(Y-5)
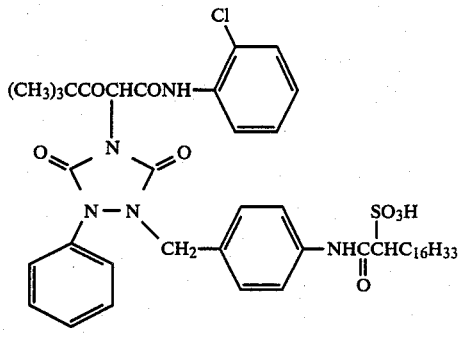
(Y-6)
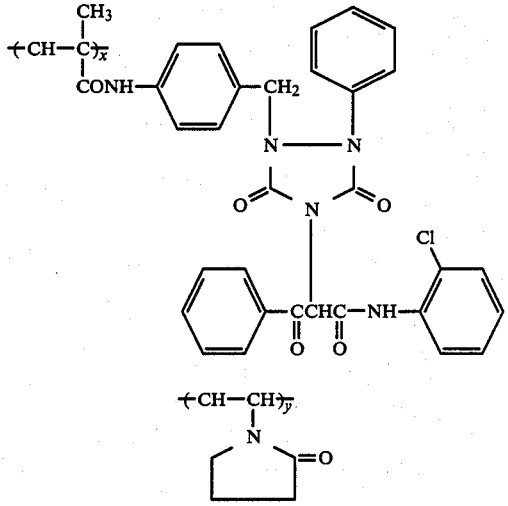
(x = 30% by wt
y = 70% by wt)
(Y-7)
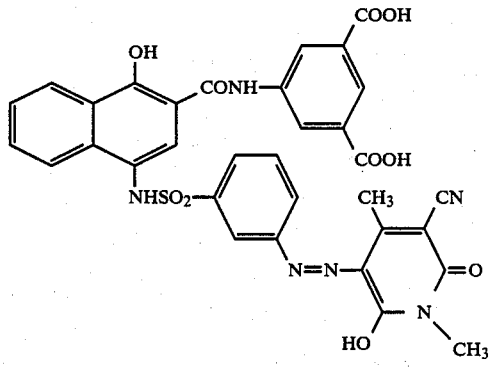
The following are typical examples of the magenta dye donator:

Exemplified Compounds:
(M-1)
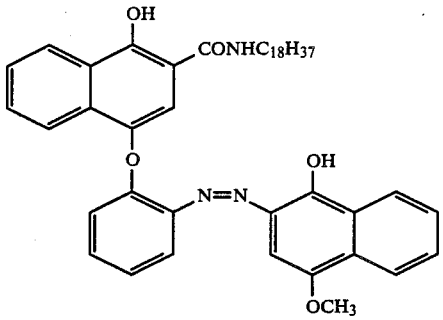
(M-2)
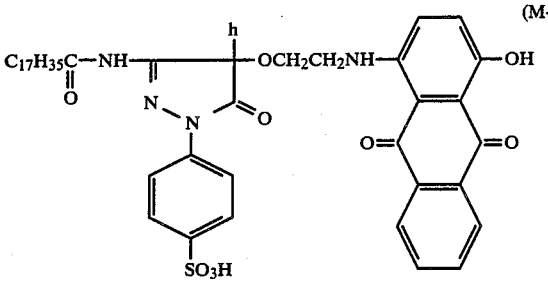
(M-3)
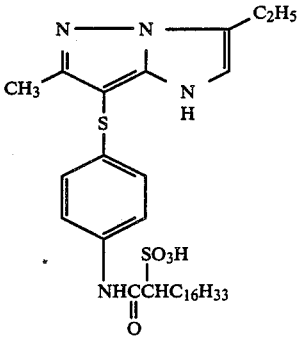
(M-4)
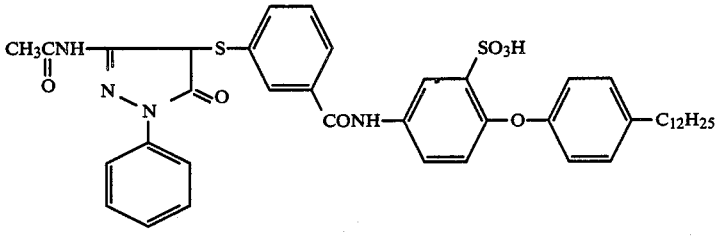
(M-5)
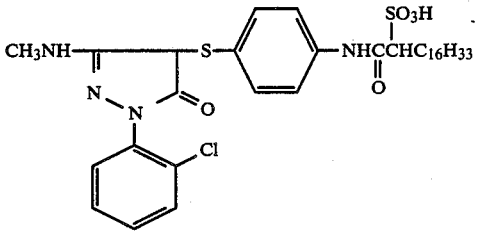
(M-6)
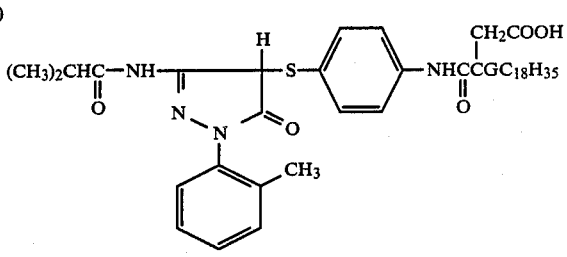
(M-7)
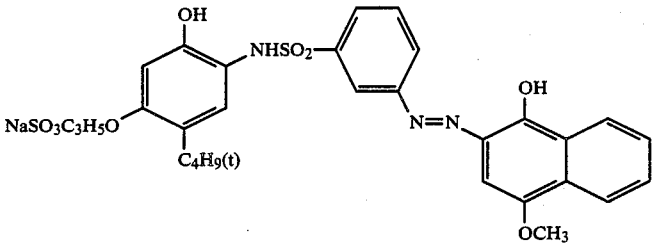
Further, the following are typical examples of the cyan dye donator:

Exemplified Compounds:

(C-1)

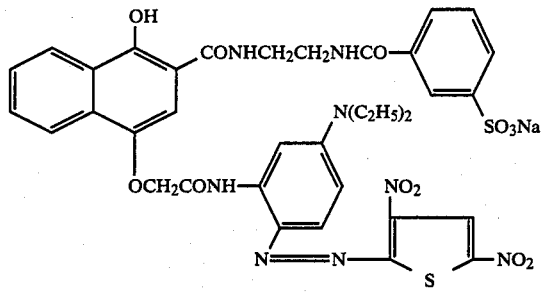

(C-2)

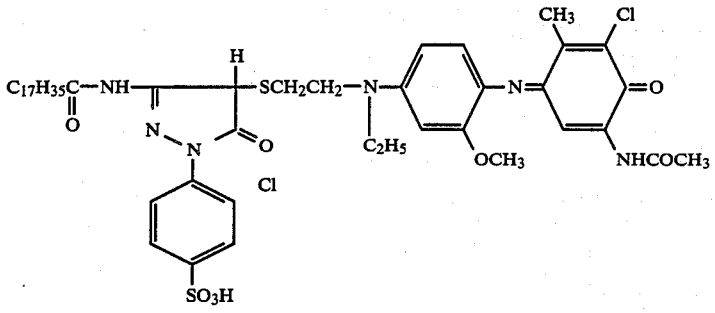

(C-3)

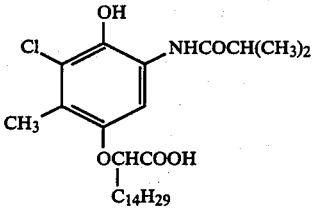

(C-4)

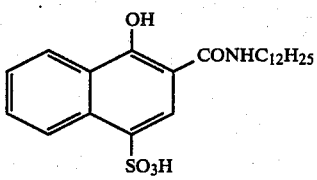

(C-5)

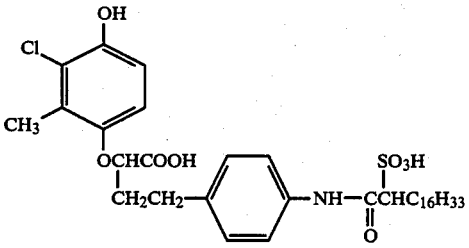

(C-6)

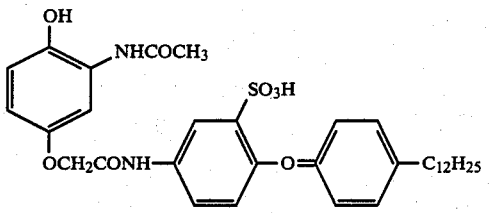

(C-7)

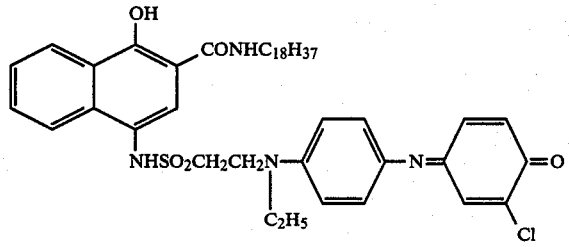

The using quantity of the dye donator of this invention, although it depends on the heat-development-type light-sensitive composition, coating conditions, processing method, etc., used, is in the range of from about 0.01 to 10 moles per mole of the organic silver salt used, and preferably from 0.1 to 2.0 moles.

The dye donator of this invention is used by being incorporated into heat-development-type light-sensitive layers or other photographic component layers. In order to incorporate it into, e.g., the heat-development-type light-sensitive layer, the incorporation may be made through dissolving the dye donator in a high-boiling solvent as described in U.S. Pat. No. 2,322,027 on a method for dispersing couplers. Further, in the above method for dispersion, a low-boiling solvent may also be used in combination with the high-boiling solvent to dissolve the dye donator to be incorporated into the heat-development-type light-sensitive layer.

Those solvents known as the high-boiling solvent include, e.g., di-n-butyl phthalate, tricresyl phosphate, dioctyl phthalate, n-nonyl-phenol, etc., and those known as the low-boiling solvent include, e.g., methyl acetate, butyl propionate, cyclohexanol, diethyleneglycol monolaurate, etc. These solvents may be used alone or in a mixture. The dye donator thus dissolved in such solvents may be mixed with an aqueous solution containing such a hydrophilic binder material as gelatin containing an anionic surface active agent such as an alkylbenzenesulfonic acid or alkylnaphthalenesulfonic acid, etc., and/or a nonionic surface active agent such as a sorbitan-monolaurate, and the mixture may be emulsifiedly dispersed by means of a colloid mill or ultrasonic disperser to be incorporated into the heat-development-type light-sensitive layer.

The above-mentioned high-boiling solvent is used in a quantity necessary for completely dissolving the dye donator; the quantity is preferably from 0.05 to 100 parts per part of the dye donator.

There is another method for dispersion called "Fischer's dispersion" as a preferred dispersion method other than the above method. The Fischer's dispersion is such that a dye donator having both hydrophilic and hydrophobic components in the same molecule thereof is dissolved into an aqueous alkaline solution to be dispersed. In this dissolution and dispersion, an organic solvent having compatibility with water may be added, or the dye donator may be heated or stirred (by means of a homogenizer or ultrasonic disperser), or this process may be effected with the aid of a surface active agent. The alkali agent for such the aqueous alkaline solution may be an inorganic base or organic base compatible with water. After dissolution/dispersion of the dye donator, the mixture may, if necessary, be subjected to pH control. For the pH control an organic or inorganic acid compatible with water may be used. As the surface active agent used as the dispersion assistant anionic or nonionic surface active agents may be used, and of these agents anionic surface active agents are most suitably used.

In addition, the above Fischer's dispersion is sometimes called "Agfa dispersion," for which reference can be made to the details described in British Patent Nos. 45,555, 465,823 and 29,897.

The heat-development-type light-sensitive layer of this invention contains a light-sensitive silver halide along with the foregoing dye donator.

The light-sensitive silver halide used in this invention includes silver chloride, silver bromide, silver iodide, silver chlorobromide, silver chloroiodide, silver iodobromide, silver chloroiodobromide, and a mixture of these halides. The light-sensitive silver halide emulsion may be prepared by any one of such methods as the single-jet method, double-jet method, and the like, which are known to those skilled in the art, but in this invention the light-sensitive silver halide will give better results when prepared in usual manner.

The light-sensitive silver halide emulsion may be chemically sensitized by any one of those methods well-known in the photographic field. The sensitizing methods include those methods of gold sensitization, sulfur sensitization, gold-sulfur sensitization, reduction sensitization, and the like.

The silver halide of the above emulsion is allowed to be coarse-grained or fine-grained, but the preferred particle size of the silver halide should be from about 1.5 $\mu$m to about 0.001 $\mu$m, and more preferably from about 0.5 $\mu$m to about 0.01 $\mu$m.

The above-prepared light-sensitive silver halide emulsion can be most suitably applied to the heat-development-type light-sensitive layer, the component layer of the light-sensitive material of this invention.

In the present invention, another method for the preparation of the light-sensitive silver halide may also be used which is such that a light-sensitive silver salt forming component may be made present together with an organic silver salt, and a light-sensitive silver halide may be formed as part of the organic silver salt. The light-sensitive silver salt-forming component for use in this preparation includes inorganic halides such as those halides represented by MXn (wherein M represents a hydrogen atom, an $NH_4$ group or a metallic atom; X represents Cl, Br or I; and n is 1 when the M is a hydrogen atom or an $NH_4$ group, and, when the M is a metallic atom, is the valence thereof, the metallic atom including lithium, sodium, potassium, rubidium, cecium, copper, gold, beryllium, magnesium, calcium, strontium, barium, zinc, cadmium, mercury, aluminum, indium, lanthanum, ruthenium, thalium, germanium, tin, lead, antimony, bismuth, chromium, molybdenum, tungsten, manganese, rhenium, iron, cobalt, nickel, rhodium, palladium, osmium, iridium, platinum, cerium, etc.), halogen-containing metallic complexes (such as $K_2PtCl_6$, $K_2PtBr_6$, $HAuCl_4$,$(NH_4)_2IrCl_6$,$(NH_4)_3IrCl_6$,$(NH_4)_2RuCl_6$,$(NH_4)_3RuCl_6$, $(NH_4)_3RhCl_6$,$(NH_4)_3RhBr_6$, etc.), onium halides (such as tetramethyl-ammonium bromide, trimethyl-phenyl-ammonium bromide, cetyl-ethyl-dimethyl-ammonium bromide, 3-methyl-thiazolium bromide, quaternary ammonium halides such as trimethyl-benzylammonium bromide, quaternary phosphonium halides such as tetraethyl-phosphonium bromide, benzyl-ethyl-methyl bromide, tertiary sulfonium halides such as 1-ethyl-thiazolium bromide, etc.), halogenated hydrocarbons (such as iodoform, bromoformcarbon tetrabromide, 2-bromo-2-methyl-propane, etc.), N-halogenated compounds (such as N-chlorosuccinic acid imide, N-bromosuccinic acid imide, N-bromophthalic acid imide, N-bromoacetanilide, N-iodosuccinic acid imide, N-bromophthalazinone, N-chlorophthalazinone, N-bromoacetanilide, N,N-dibromobenzenesulfonamide, N-bromo-N-methylbenzenesulfonamide, 1,3-dibromo4,4-dimethyl-hydantoin, etc.), and other halogen-containing compounds (such as triphenyl-methyl chloride, triphenyl-methyl bromide, 2-bromobutyric acid, 2-bromobutyric acid, 2-bromoethanol, etc.), and the like.

These light-sensitive silver halide and light-sensitive silver salt-forming components may be used in combination in various manners, and the using amount thereof is from 0.001 mole to 5.0 moles per mole of the organic silver salt, and preferably from 0.01 mole to 2.0 moles.

Also, the light-sensitive silver halide used in this invention differs in the color sensitivity according to the respective layers. For example, a blue-sensitive silver halide is used for the layer containing an yellow dye donator, a green-sensitive silver halide is used for the layer containing a magenta dye donator, and a red-sensitive silver halide is used for the layer containing a cyan dye donator. However, the above combinations are not necessarily imperative, depending on the exposure method used, and different other embodiments may also be applied.

The blue-sensitive silver halide, green-sensitive silver halide and red-sensitive silver halide emulsions used in this invention can be obtained by adding appropriate spectrally-sensitizing dyes to the foregoing silver halide emulsion.

These typical spectrally-sensitizing dyes used in this invention include, e.g., cyanines, merocyanines, complex (3- or 4-nucleus) cyanines, holopolacyanines, styryls, hemicyanines, oxonols, and the like. Of cyanine dyes the preferred ones are those having a basic nucleus such as thiazoline, oxazoline, pyrroline, pyridine, oxazole, thiazole, selenazole, imidazole, or the like. These nuclei are allowed to have an alkyl, alkylene, hydroxylalkyl, sulfoalkyl, carboxyalkyl or aminoalkyl group, or an enamine group capable of forming a condensed carbocyclic or heterocyclic ring, and also allowed to be of the symmetrical or asymmetrical form, and further the methine chain or polymethine chain thereof is allowed to have an alkyl, phenyl, enamine or heterocyclic substituent.

Merocyanine dyes are allowed to have an acid nucleus such as, e.g., thiohydantoin nucleus, rhodanine nucleus, oxazolidinedione nucleus, thiazolidinedione nucleus, barbituric acid nucleus, thiazolinethione nucleus, malononitrile nucleus, pyrazolone nucleus, etc., in addition to the above-mentioned basic nuclei. These acid nuclei are allowed to have further such a substituent as an alkyl, alkylene, phenyl, carboxylalkyl, sulfoalkyl, hydroxyalkyl, alkoxyalkyl, alkylamine or heterocyclic group. And, if necessary, these dyes may be used in combination. Further these dyes may be used in combination with such supersensitizing additives absorbing no visible rays as ascorbic acid derivatives, azaindene cadmium salts, organic sulfonic acids, as described in U.S. Pat. Nos. 2,933,390 and 2,937,089.

The adding quantity of these dyes is from $1\times10^{-4}$ to 1 mole per mole of the silver halide or silver halide-forming component, and preferably from $1\times10^{-4}$ to $1\times10^{-1}$ mole.

The organic silver salt used for the heat-development-type color light-sensitive material of this invention includes aliphatic carboxylic acid silver salts such as silver laurate, silver myristate, silver palmitate, silver stearate, silver arachidonate, silver behenate, etc.; aromatic carboxylic acid silver salts such as silver benzoate, silver phthalate, etc.; imino group-having silver salts such as silver benzotriazole, silver saccharine, silver phthalazinone, silver phthalmide, etc.; silver salts of mercapto group- or thione group-having compounds such as silver 2-mercaptobenzoxazole, silver mercaptoxadiazole, silver mercaptobenzothiazole, silver 2-mercaptobenzoimidazole, silver 3-mercaptophenyl-1,2,4-triazole; and other silver compounds such as silver 4-hydroxy-6-methyl-1,3,3a,7-tetrazaindene, silver 5-methyl-7-hydroxy-1,2,3,4,6-pentazaindene, etc., as described in Japanese Examined Publication Nos. 4924/1968, 26582/1969, 18416/1970, 12700/1970 and 22185/1970; Japanese Patent O.P.I. Publication Nos. 52626/1974, 31728/1977, 13731/1977, 141222/1977, 36224/1978 and 37610/1978; and U.S. Pat. Nos. 3,330,633 and 4,168,980.

In addition, those silver compounds as described in Research Disclosure Nos. 16966 and 16907; and British Pat. Nos. 1,590,956 and 1,590,957 may also be used. Especially, those imino group-having silver salts such as, for example, benzotriazole silver salts are preferred which include alkyl-substituted silver benzotriazoles such as silver methylbenzotriazole, halogen-substituted silver benzotriazoles such as silver bromobenzotriazole, amido-substituted silver benzotriazoles such as silver 5-acetamidobenzotriazole, and those compounds as described in British Pat. Nos. 1,590,956 and 1,590,957 including, e.g., silver N-[6-chloro-4-N(3,5-dichloro-4-hydroxyphenyl)-imino-1-oxo-5-methyl-2,5-cyclohexadiene-2-yl]-5-carbamoyl-benzotriazole, silver 2-benzotriazole-5-ylazo-4-methoxy-1-naphthol, silver 1-benzotriazole-5-ylazo-2-naphthol, silver N-benzotriazole-5-yl-4-(4-dimethylaminophenylazo)-benzamido, and the like.

Further, those nitrobenzotriazoles having the following Formula (16) and those benzotriazoles having the following Formula (17) may also be advantageously used:

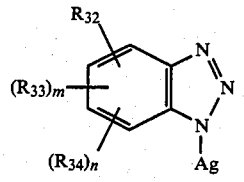

Formula (16)

wherein $R_{32}$ is a nitro group; $R_{33}$ and $R_{34}$ may be either the same as or different from each other and each is a halogen atom (such as chlorine, bromine or iodine), a hydroxy group, a sulfo group or a salt thereof (such as sodium salt, potassium salt or ammonium salt) a carboxy group or a salt thereof (such as sodium salt, potassium salt or ammonium salt), a nitro group, a cyano group, or a substitutable carbamoyl or sulfamoyl group, a substitutable alkyl group (such as methyl, ethyl or propyl), a substitutable alkoxy group (such as methoxy or ethoxy), a substitutable aryl group (such as phenyl) or a substitutable amino group; m is up to 2; and n is zero or 1. The substituent to the above-mentioned substitutable carbamoyl group includes, e.g., methyl group, ethyl group, acetyl group, etc., that to the above substitutable sulfamoyl group includes, e.g., methyl group, ethyl group, acetyl group, etc.; that to the above substitutable alkyl group includes carboxy group, ethoxycarbonyl group, etc.; that to the above substitutable aryl group includes sulfo group, nitro group, etc.; that to the above substitutable alkoxy group includes carboxy group, ethoxycarbonyl group, etc.; and that to the above substitutable amino group includes acetyl group, methanesulfonyl group, hydroxy group, etc.

Those compounds having Formula (16) are silver salts of benzotriazole derivatives having at least one nitro group, examples of which include the following compounds: silver 4nitrobenzotriazole, silver 5-nitrobenzotriazole, silver 5-nitro-6-chlorobenzotriazole, silver 5-nitro-6-methylbenzotriazole, silver 5-nitro-6-methoxybenzotriazole, silver 5-nitro-7-phenylbenzotriazole, silver 4-hydroxy-5-nitrobenzotriazole, silver 4-hydroxy-7-nitrobenzotriazole, silver 4-hydroxy-5,7-dinitrobenzotriazole, silver 4-hydroxy-5-nitro-6-chlorobenzotriazole, silver 4-hydroxy-5-nitro-6-methylbenzotriazole, silver 4-sulfo-6-nitrobenzotriazole, silver 4-carboxy-6-nitrobenzotriazole, silver 5-carboxy-6-nitrobenzotriazole, silver 4-carbamoyl-6-nitrobenzotriazole, silver 4-sulfamoyl-6-nitrobenzotriazole, silver 5-carboxymethyl-6-nitrobenzotriazole, silver 5-hydroxycarbonylmethoxy-6-nitrobenzotriazole, silver 5-nitro-7-cyanobenzotriazole, silver 5-amino-6-nitrobenzotriazole, silver 5-nitro-7-(p-nitrophenyl)benzotriazole, silver 5,7-dinitro-6-methylbenzotriazole, 5,7-dinitro-6-chlorobenzotirazole, silver 5,7-dinitro-6-methoxybenzotriazole, and the like.

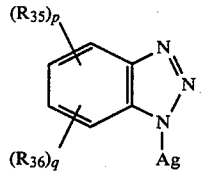

Formula (17)

wherein $R_{35}$ is a hydroxy group, a sulfo group or a salt thereof (such as sodium salt, potassium salt or ammonium salt), a carboxy group or a salt thereof (such as sodium salt, potassium salt or ammonium salt), a substitutable carbamoyl group or a substitutable sulamoyl group; $R_{36}$ is a hydrogen atom (such as chlorine, bromine or iodine), a hydroxy group, a sulfo group or a salt thereof (such as sodium salt, potassium salt or ammonium salt), a carboxy group or a salt thereof (such as sodium salt, potassium salt or ammonium salt), a nitro group, a cyano group, or a substitutable alkyl group (such as methyl, ethyl pr propyl), a substitutable aryl group (such as phenyl), a substitutable alkoxy group (such as methoxy or ethoxy) or a substitutable amino group; p is 1 or 2; and q is an integer of up to 2.

The substitutent to the above-mentioned substitutable carbamoyl group represented by $R_{35}$ includes, e.g., methyl group, ethyl group, acetyl group, etc.; and that to the above substitutable sulfamoyl group includes methyl group, ethyl group, acetyl group, etc. The substitutent to the above substitutable alkyl group includes, e.g., carboxy group, ethoxycarbonyl group, etc.; that to the above substitutable aryl group includes sulfo group, nitor group, etc.; that to the above substitutable alkoxy group includes carboxy group, ethoxycarbonyl group, etc.; and that to the above substitutable amino group includes acetyl group, methanesulfonyl group, hydroxy group, etc.

Examples of those organic silver salts having Formula (17) include the following compounds: silver 4-hydroxybenzotriazole, silver 5-hydroxybenzotriazole, silver 4-sulfobenzotriazole, silver 5-sulfobenzotriazole, silver benzotriazole-sodium 4-sulfonate, silver benzotriazole-sodium 5-sulfonate, silver benzotriazole-potassium 4-sulfonate, silver benzotriazole-potassium 5-sulfonate, silver benzotriazole-ammonium 4-sulfonate, silver benzotriazole-ammonium 5-sulfonate, silver 4-carboxybenzotriazole, silver 5-carboxybenzotriazole, silver benzotriazole-sodium 4-carboxylate, silver benzotriazole-sodium 5-carboxylate, silver benzotriazole-potassium 4-carboxylate, silver benzotriazole-potassium 5-carboxylate, silver benzotriazole-ammonium 4-carboxylate, silver benzotriazole-ammonium 5-carboxylate, silver 5-carbamoylbenzotriazole, silver 4-sulfamoylbenzotriazole, silver 5-carboxy-6-hydroxybenzotriazole, silver 5-carboxy-7-sulfobenzotriazole, silver hydroxy-5-sulfobenzotriazole, silver 4-hydroxy-7-sulfobenzotriazole, silver 5,6-dicarboxybenzotriazole, silver 4,6-dihydroxybenzotriazole, silver 4-hydroxy-5 chlorobenzotriazole, silver 4-hydroxy-5-methylbenzotriazole, silver 4-hydroxy-5-methoxybenzotriazole, silver 4-hydroxy-5-nitrobenzotriazole, silver 4-hydroxy-5-cyanobenzotriazole, silver 4-hydroxy-5-cyanobenzotriazole, silver 4-hydroxy-5-aminobenzotriazole, silver 4-hydroxy-5-acetamidobenzotriazole, silver 4-hydroxy-5-benzenesulfonamidobenzotriazole, silver 4-hydroxy-5-hydroxycarbonylmethoxybenzotriazole, silver 4-hydroxy-5-ethoxycarbonylmethoxybenzotriazole, silver 4-hydroxy 5-carboxymethylbenzotriazole, silver 4-hydroxy-5-ethoxycarbonylmethylbenzotriazole, silver 4-hydroxy-5-phenylbenzotriazole, silver 4-hydroxy-5-(p-nitrophenyl)benzotriazole, silver 4-hydroxy-5-(p-sulfophenyl)benzotriazole, silver 4-sulfo-5-chlorobenzotriazole, silver 4-sulfo-5-methylbenzotriazole, silver 4-sulfo-5-methoxybenzotriazole, silver 4-sulfo-5-cyanobenzotriazole, silver 4-sulfo-5-aminobenzotriazole, silver 4-sulfo-5-acetamidobenzotriazole, silver 4-sulfo-5-benzenesulfonamidobenzotriazole, silver 4-sulfo-5-hydroxycarbonylmethoxybenzotriazole, silver 4-sulfo-5-thoxycarbonylmethoxybenzotriazole, silver 4-hydroxy-5-carboxybenzotriazole, silver 4-sulfo-5-carboxymethylbenzotriazole, silver 4-sulfo-5-ethoxycarbonylmethylbenzotriazole, silver 4-sulfo-5-phenylbenzotriazole, silver 4-sulfo-5-(p-nitrophenyl)benzotriazole, silver 4-sulfo-5-(p-sulfophenyl)benzotriazole, silver 4-sulfo-5-methoxy-6-chlorobenzotriazole, silver 4-sulfo-5-chloro-6-carboxybenzotriazole, silver 4-carboxy-5-chlorobenzotriazole, silver 4-carboxy-5-methylbenzotriazole, silver 4-carboxy-5-nitrobenzotriazole, silver 4-carboxy-5-aminobenzotriazole, silver 4-carboxy-5-methoxybenzotriazole, silver 4-carboxy-5-acetamidobenzotriazole, silver 4-carboxy-5-ethoxycarbonylmethoxybenzotriazole, silver 4-carboxy-5-carboxymethylbenzotriazole, silver 4-carboxy-5-phenylbenzotriazole, silver 4-carboxy-5-(p-nitrophenyl)benzotriazole, silver 4-carboxy-5-methyl-7-sulfobenzotriazole, and the like. These compounds may be used alone or in combination of two or more of them.

A method for the preparation of the organic silver salt used in this invention will be described hereinafter, but as for the organic silver salt, an isolated one may be used by dispersing it into a binder by appropriate means, or the salt may be prepared in an appropriate binder and then used as it is without being isolated.

The quantity of the organic silver salt is from 0.05 g to 10.0 g per $m^2$ of the support, and preferably from 0.2 g to 2.0 g.

The reducing agent to be used for the heat-development-type color light-sensitive material of this invention includes those known color developing agents such as p-phenylenediamine-type and p-aminophenol-type developing agents, phosphoroamidophenol-type and sulfonamidophenol-type developing agents, and hydrazone-type color developing agents, etc., or precursors of these agents, as described in U.S. Pat. Nos. 3,531,286, 3,761,270 and 3,764,328; Research Disclosure Nos. 12146, 15108 and 15127; and Japanese Patent O.P.I. Publication No. 27132/1981, and the most preferred are p-(N,N-dialkylaminophenyl)-sulfamine developing agents as described in Japanese Patent O.P.I. Publication No. 146133/1981 and our Japanese Patent Application No. 225928/1982.

These reducing agents may be used either alone or in combination. The using quantity of the reducing agent, although it depends on the type of the organic silver salt used, the type of the light-sensitive silver salt used, and other additives used, is usually from 0.05 mole to 10 moles per mole of the organic silver salt, and preferably from 0.1 mole to 3 moles.

The heat-development-type color light-sensitive material of this invention may, if necessary, contain various additives in addition to the above-described components. For example, additives usable as the development accelerator include those alkali-releasing agents as described in U.S. Pat. Nos. 3,220,840, 3,531,285, 4,012,260, 4,060,420, 4,088,496 and 4,207,392; and Research Disclosure Nos. 15733, 15734 and 15776, those organic acids as described in Japanese Patent Examined Publication No. 12700/1970, those nonaqueous polar solvent compounds having —CO—, —$SO_2$— and —SO— groups as described in U.S. Pat. No. 3,667,959, those melt formers as described in U.S. Pat. No. 3,438,776, and those polyalkylene glycols as described in U.S. Pat. No. 3,666,477 and Japanese Patent O.P.I. Publication No. 19525/1976 Usable as the toning agent include phthalazinone, phthalimide, pyrazolone, quinazoline, N-hydroxynaphthalimide, benzoxazine, naphthoxazinedione, 2,3-dihydro-phthalazinedione, 2,3-dihydro1,3-oxazine-2,4-dione, oxypyridine, aminopyridine, hydroxyquinoline, aminoquinoline, isocarbstyryl, sulfonamide, 2H-1,3-benzothiazine-2,4-(3H)dione, benzotriazine, mercaptotriazole, dimercaptotetrazapentalene, phthalic acid, naphthalic acid, phthalamic acid, and the like, which are the compounds described in Japanese Patent O.P.I Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 16525/1979, 16526/1979, 4060/1980, 4061/1980 and 32015/1980; West German Pat. Nos. 2,140,406, 2,147,063 and 2,220,618; and U.S. Pat. Nos. 3,080,254, 3,847,612 3,782,941, 3,994,732, 4,123,282 and 4,201,582, and a mixture of one or two or more of these compounds with imidazole compounds, a mixture of phthalazine compounds with at least one of acids such as phthalic acid, naphthalic acid, etc., or acid anhydrides, and further, a combination of phthaladine with maleic acid, itaconic acid, quinolic acid, gentisic acid, etc., and the like. Further, the 3-amino-5-mercapto-1,2,4-triazoles and 3-acylamino-5-mercapto-1,2,4-triazoles described in our Japanese Patent Application Nos. 73215/1982 and 76838/1982 are also effective.

And usable as the antifoggant are those compounds as described in Japanese Patent Examined Publication No. 11113/1972; Japanese Patent O.P.I. Publication Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1979 and 93149/1980; British Pat. No. 1,455,271; U.S. Pat. Nos. 3,855,968, 3,700,457, 4,137,079 and 4,138,265; and West German Pat. No. 2,617,907, which include mercuric salts, oxidizing agents (such as N-halogenoacetamide, N-halogenosuccinic acid imide, perchloric acid and perchlorates, inorganic peroxides, persulfates, etc.), acids and the salts thereof (such as sulfinic acid, lithium laurate, rosin, diterpenic acid, thiosulfonic acid, etc.), sulfur-containing compounds (such as mercapto compound-releasing compounds, thiouracil, disulfides, sulfur (single substance), mercapto-1,2,4-triazole, thiazolinethione, polysulfide compounds, etc.), and other compounds such as oxazoline, 1,2,4-triazoles, phthalimide, etc., and the like.

In addition, those hydrophilic benzotriazole derivatives such as 4-sulfobenzotriazole, 5-carboxybenzotriazole, etc., and phenolic hydroxyl group-having oxidizing agents such as hydroquinone derivatives as described in Japanese Patent Application Nos. 66380/1984 and 56506/1984 are also useful as the antifoggant. Especially, combined use of the hydrophilic benzotriazole derivative with the hydroquinone derivative further increases the antifogging effect.

Further, as the stabilizing agent, particularly a post-treatment anti-printout agent may be simultaneously used which includes those halogenated hydrocarbons such as tetrabromobutane, tribromoethane, 2-bromo-2-tolylacetamide, 2-bromo-2-tolylsulfonylacetamide, 2-tolylbromomethylsulfonylbenzothiazole, 2,4-bis(tribromomethyl)-6-methyltriazine, etc., as described in Japanese Patent O.P.I. Publication Nos. 45228/1973, 19624/1975, 120328/1975 and 46020/1978.

Also, as described in Japanese Patent Examined Publication No. 5393/1971; and Japanese Patent O.P.I. Publication Nos. 54329/1975 and 77034/1975, sulfur-containing compounds may be used for the post treatment.

Further, those isothiuronium-type stabilizer-precursors as described in U.S. Pat. Nos. 3,301,678, 3,506,444, 3,824,103 and 3,844,788, those activator-stabilizer-precursors as described in U.S. Pat. Nos. 3,669,670, 4,012,260 and 4,060,420 and the like, may be contained in a liquid for the above treatment.

Into the heat-development-type color light-sensitive material of this invention may, if necessary, be incorporated various additives such as spectrally sensitizing dyes, antihallation dyes, brightening agents, hardeners, antistatic agents, plasticizers, coating aids, etc., in addition to the above described components.

The foregoing light-sensitive silver halide, organic silver salt, reducing agent, dye donator, heat solvent, and the like, which are the components of the heat-development-type color light-sensitive material of this invention, are allowed to be contained either together in a same single layer or apart in two separate layers adjacent to each other.

The heat-development-type color light-sensitive material of this invention, in order to prevent possible occurrence of turbid color, is desirable to have, in addition to the above layers, an interlayer between the respective different light-sensitive layers.

The above-mentioned interlayer may be a plain binder layer, and may also be a layer containing the same heat solvent, organic silver salt or reducing agent as those contained in the light-sensitive layer, and is desirable to contain a compound capable of scavenging the oxidized product of the reducing agent (hereinafter abridged to "Dp' scavenger").

The particularly preferred compound as the above Dp' scavenger is a coupler having an immobile group in the nonactive-site substituent thereof. The preferred group as the above immobile group is a group whose total number of carbon atoms is not less than 8 and/or a sulfo group, a hydrophilic group such as a hydroxy group, or a polymer residue Examples of the above Dp' scavenger are described in, e.g., Japanese Patent O.P.I Publication No.

The binder to be used as the foregoing interlayer is either a hydrophilic or hydrophobic binder, and particularly desirable to be the same binder as that used in the light-sensitive layer.

The layer containing the foregoing various components and other layers in this invention may be coated on any one of a variety of supports. The support usable in this invention may be of any such materials as plastic films including cellulose-nitrate film, cellulose-ester film, polyvinyl-acetal film, polyethylene film, polyethylene-terephthalate film, polycarbonate film, etc., glass plates, paper, metals such as aluminum, etc., and the like In addition, aside from the above, photographic component layers such as an overcoat layer, subbing layer, backing layer, filter layers, etc., may be provided The heat-development-type color light-sensitive material of this invention is exposed imagewise and then heat-developed, whereby the heat-transferrable dye-imagewise distribution is formed from the foregoing dye donator, at least part of which imagewise distribution is then transferred onto an image-receiving member having superposed relation with the light-sensitive material, thus forming a color image.

For the dye transfer onto the above mentioned image-receiving member, any of various transfer methods such as for example, the transfer which uses water or an organic solvent such as methanol, acetonitrile, dimethylformamide, etc., or the heat transfer which uses a heat solvent, the heat-movable transfer by the sublimation of a dye itself, and the like, may be used. In the case where a heat solvent is contained in the light-sensitive material, the dye transfer can be effected by merely heating the light-sensitive material closely contacted with the image-receiving member.

The image-receiving member is enough if receptive of the dye thermally released or formed, but desirable to be formed of a mordant used in dye diffusion transfer-type light-sensitive materials, or a heat-resistant organic high-molecular material whose glass transition temperature is in the range of from 40° C. to 250° C., described in Japanese Patent O.P.I. Publication No. 207250/1982.

Examples of the above-mentioned mordant includes nitrogen-containing secondary or tertiary amines, nitrogen-containing heterocyclic compounds and quaternary cationic compounds thereof, those vinyl-pyridine polymers and vinyl-pyridine cationic polymers as disclosed in U.S. Pat. Nos. 2,548,564, 2,484,430, 3,148,061 and 3,756,814, those dialkylamino group-containing polymers as disclosed in U.S. Pat. No. 2,675,316, those aminoguanidine derivatives as disclosed in U.S. Pat. No. 2,882,156, those mordants cross-linkable with gelatin, etc., as disclosed in U.S. Pat. Nos. 3,625,694 and 3,859,096, and British Pat. Nos. 1,277,453 and 2,011,012, those aqueous sol-type mordants as disclosed in U.S. Pat. Nos. 3,958,995, 2,721,852 and 2,798,063, those water-insoluble mordants as disclosed in Japanese Patent O.P.I. Publication No. 61228/1975, and those various mordants as disclosed in U.S. Pat. No. 3,788,855, West German OLS Patent No. 2,843,320, Japanese Patent O.P.I, Publication Nos. 30328/1978, 155528/1977, 125/1978, 1024/1978, 74430/1979, 124726/1979 and 22766/1980, U.S. Pat. Nos. 3,642,482, 3,488,706, 3,557,066, 3,271,147 and 3,271,148, Japanese Patent Examined Publication Nos. 29418/1980, 36414/1981 and 12139/1982, and Research Disclosure No. 12045 (1974).

The most useful mordants are those ammonium salt-containing polymers as described in U.S. Pat. No. 3,709,690. A typical example of the ammonium salt-containing polymers is polystyrene-co-N,N,N-tri-n-hexyl-N-vinyl-benzylammonium chloride. The proportion of the styrene to the vinyl-benzylammonium chloride is from 1:4 to 4:1, and preferably 1:1.

The typical dye-diffusion-transfer image-receiving layer can be obtained by coating the ammonium salt-containing polymer mixed with gelatin on a support. The transfer of the dye from the heat-development-type light-sensitive layer onto the image-receiving layer may be made by use of a transfer solvent. The transfer solvent includes low-boiling solvents such as methanol, ethyl acetate, diisobutyl ketone, etc., and high-boiling solvents such as tri-n-cresyl phosphate, di-n-butyl phthalate, etc. In the case of a high-boiling solvent, it may be emulsified by use of an appropriate emulsifier into gelatin thereby to be incorporated into the image-receiving layer.

Examples of the foregoing heat-resistant organic high-molecular material include polystyrene having a molecular weight of from 2000 to 85000, polystyrene derivatives with a substituent having not more than 4 carbon atoms, polyvinyl-cyclohexane, polydivinyl-benzene, polyvinyl-pyrrolidone, polyvinyl-carbazole, polyallyl-benzene, polyvinyl alcohol, polyacetals such as polyvinyl formal, polyvinyl butyral, etc., polyvinyl chloride, chlorinated polyethylene, polyethylene trichloride-fluoride, polyacrylonitrile, poly-N,N-dimethyl-allylamide, p-cyanophenyl group-having, pentachlorophenyl group-having and 2,4-dichlorophenyl group-having polyacrylates, polyacryl chloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethylene-glycol dimethacrylate, poly-2-cyano-ethyl methacrylate, polyesters such as polyethylene terephthalate, etc., polysulfone, polycarbonates such as bisphenol A polycarbonate, etc., polyanhydrides, polyamides, and cellulose acetates. And those synthetic polymers having a glass transition point of not less than 40° C. as described in Polymer Handbook 2nd ed. (compiled by J. Brabdrup, E. H. Immergut), published by John Wiley & Sons, also are useful. These high-molecular materials may be used alone or in the form of copolymers in combination.

The particularly useful polymers include cellulose acetates such as triacetate, diacetate, etc.; polyamides in combination of heptamethylenediamine with terephthalic acid, of fluorenedipropylamine with adipic acid, of hexamethylenediamine with diphenic acid, of hexamethylenediamine with isophthalic acid, and the like; polyesters in combination of diethylene glycol with diphenyl-carboxylic acid, of bis-p-carboxyphenoxybutane with ethylene glycol, and the like; polyethylene terephthalate; polycarbonate, and polyvinyl chloride.

These polymers may be ones reformed. For example, such polyethylene terephthalate as is reformed by use of a reforming agent such as cyclohexanedimethanol, isophthalic acid, methoxypolyethylene glycol, 1,2-di-carbomethoxy-4-benzenesulfonic acid, or the like, may also be useful.

Any of the above-mentioned polymers may be dissolved in an appropriate solvent, and the solution is coated over a support to form an image-receiving layer; or prepared to be a film-form image-receiving layer to be laminated over a support; or used alone, without being coated over any support, to constitute an image-receiving member (e.g., film form)(image-receiving layer functional also as its support).

Further, the image-receiving layer, formed on a transparent support, may have thereon an opaque layer (reflective layer) containing titanium dioxide dispersed into gelatin. The opaque layer serves to enable the transferred color image to clearly appear as a reflective-type color image when viewed from the transparent support side.

The present invention will be illustrated further in detail by the following examples, but the embodiment of this invention is not limited thereto.

EXAMPLE 1

(Preparation of silver 4-sulfobenzotriazole)

Forty grams of 4-sulfobenzotriazole and 8.0 g of sodium hydroxide were added to and dissolved in 500 ml of an ethanol-water (1:1) mixture liquid containing 40 g of polyvinyl pyrrolidone. To this solution were added dropwise 33 ml of a five-normal silver nitrate solution. At this time a five-normal sodium hydroxide solution also was simultaneouly added dropwise to maintain the pH at 7 to 8. To this solution, after being stirred for an hour at room temperature, was added water to make the whole quantity thereof 600 ml, whereby a silver 4-sulfobenzotriazole solution was obtained.

(Preparation of a cyan dye donator-containing layer)

Zero point two five gram of Exemplified Dye Donator (C-3) and 0.02 g of 2,5-di-(t-octyl)hydroquinone were dissolved into 0.75 g of ethyl acetate containing 0.2 g of dioctyl phthalate, and this solution was added to 2.5 ml of an aqueous 3.2% gelatin solution and dispersed by means of a homogenizer. After that, water was added to this to make the whole quantity thereof 5 ml, whereby a cyan dye donator-dispersed liquid was obtained.

Five milliliters of the above-dispersed liquid were mixed with 6 ml of the foregoing silver 4-sulfobenzotriazole solution, and to the mixture were added 0.32 g of petriol (3-methylpentan-1,3,5-triol), 0.16 g of polyethylene glycol (molecular weight 300) and 0.28 g of a developing agent having the following structure, and water was then added to the mixture to make the whole quantity thereof 13.4 ml. After that, the mixture was further mixed with 1.6 ml of a silver halide emulsion containing a red-sensitive silver halide (of a mean particle size of 0.1 μm) in silver equivalent of $4.8\times10^{-4}$ moles (also containing 0.12 g of gelatin) to thus prepare a coating liquid.

Developing agent:

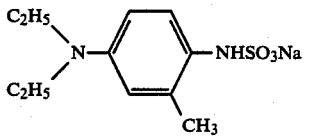

The above-prepared coating liquid was coated over a polyethylene terephthalate support so that the wet thickness thereof is 30 μm, whereby a cyan dye donator-containing layer as a first light-sensitive layer was coated.

(Preparation of a first interlayer)

Zero point three gram of a Dp' scavenger having the following structure and 0.16 ml of an aqueous 1% di-(2-ethyl-hexyl)2-sulfosuccinic acid solution and 0.2 ml of methanol were mixed, and to the mixture were added 0.5 ml of a one-normal sodium hydroxide solution and 2.5 ml of an aqueous 8% gelatin solution.

The thus obtained dispersion liquid was neutralized by use of 5% citric acid, and the whole quantity thereof was made 7 ml by adding water thereto. The dispersion liquid was then mixed with 6 ml of the silver 4-sulfobenzotriazole solution, to which were further added 0.32 g of petriol (3-methylpentane-1,3,5-triol) and 0.16 g of polyethylene glycol (molecular weight 300), and then water was added to the mixture to make the whole quantity thereof 15 ml.

Dp' Scavenger:

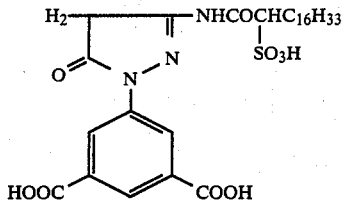

The thus obtained coating liquid for the first interlayer was coated over the foregoing first light-sensitive layer (cyan dye donator-containing layer) so that the wet thickness thereof is 15 μm, thus coating the first interlayer.

(Preparation of a magenta dye donator-containing layer)

A coating liquid of a similar composition to that of the above cyan dye donator-containing layer except that the dye donator was replaced by 0.36 g of Exemplified Dye Donator (M-6) and the light-sensitive silver halide was replaced by a green-sensitive silver halide was used and coated over the above first interlayer so that the wet thickness thereof is 30 μm, thus forming a magenta dye donator-containing layer as a second light-sensitive layer.

(Preparation of a second interlayer)

A coating liquid prepared by dispersing 0.1 g of an yellow dye having the following structure into the above first interlayer's coating liquid was used to be coated over the above magenta dye donator-containing layer so that the wet thickness thereof is 15 μm, thus forming a second interlayer.

Yellow dye:

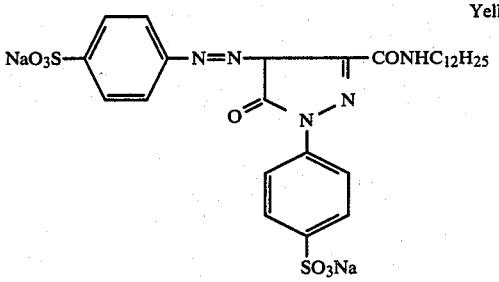

(Preparation of an yellow dye donator-containing layer)

A coating liquid of a similar composition to that of the foregoing cyan dye donator-containing layer except that the dye donator was replaced by 0.32 g of Exemplified Dye Donator (Y-3) and the light-sensitive silver halide was replaced by a blue-sensitive silver halide was used to be coated over the above second interlayer so that the wet thickness is 30 μm, thus forming an yellow dye donator-containing layer.

(Preparation of a protective layer)

A coating liquid of a similar composition to that of the first interlayer's coating liquid except that the 4-sulfobenzotriazole was eliminated therefrom was used to be coated over the above yellow dye donator-containing layer so that the wet thickness thereof is 10 μm, thus forming a protective layer The above-obtained heat-development-type color light-sensitive material, after being dried, was exposed through an optical step wedge to 1600-C M.S. white light, blue light and green light.

Subsequently, a vinyl chloride-coated image-receiving baryta paper was superposed on the coated surface of the above exposed surface of the above-exposed sample, and the sheets were contacted with and heated for 60 seconds by a metallic heat block whose surface temperature was 150° C. The image-receiving paper was then peeled apart, and the Dmax densities (maximum densities) and Dmin densities (fog densities) of the transferred dye image on the image-receiving paper were measured under blue light, green light and red light. The obtained results are as shown in Table 1.

TABLE 1

| | Blue light Measurement | | Green light Measurement | | Red light Measurement | |
|---|---|---|---|---|---|---|
| | Dmax | Dmin | Dmax | Dmin | Dmax | Dmin |
| White light exposure | 1.72 | 0.11 | 1.69 | 0.10 | 1.58 | 0.04 |
| Blue light exposure | 1.69 | 0.10 | 0.21 | 0.09 | 0.11 | 0.02 |
| Green light exposure | 0.31 | 0.10 | 1.64 | 0.09 | 0.18 | 0.04 |
| Red light exposure | 0.20 | 0.11 | 0.28 | 0.08 | 1.51 | 0.05 |

The total amount of the binder used in the measured heat-development-type color light-sensitive material sample is about 5.2 g per $m^2$ of the support, that of the gelatin used is about 1.7 g, and that of the heat solvent used is about 4.2 g, and the color light-sensitive material sample is a light-sensitive material for this invention.

As is apparent from the above table, the heat-development-type color light-sensitive material of this invention has not only excellently high maximum densities and low minimum densities but also excellent color separability.

EXAMPLE 2

Samples were prepared in quite the same manner as in Example 1 except that the total amount and kind of the binder, the amount of the gelatin, and the amount of the heat solvent (the proportion of the amount of the heat solvent to the total amount of the binder is constant: 80% by weight) were changed as shown in Table 2, and then the samples each was exposed and heat-developed in the same manner as in Example 1. The dye image transferred onto the image-receiving paper of each sample was measured in the same manner as in Example 1. The obtained results are as given in the following Table 2.

TABLE 2

| Sample No. | Binder (amount) | | Exposed to | Blue light Measurement Dmax | Blue light Measurement Dmin | Green light Measurement Dmax | Green light Measurement Dmin | Red light Measurement Dmax | Red light Measurement Dmin |
|---|---|---|---|---|---|---|---|---|---|
| 1 | Gelatin | 1.2 g | White light | 1.71 | 0.10 | 1.77 | 0.09 | 1.68 | 0.03 |
| | PVP | 2.5 g | Blue light | 1.75 | 0.11 | 0.31 | 0.09 | 0.22 | 0.04 |
| | Total | 3.7 g | Green light | 0.39 | 0.10 | 1.71 | 0.09 | 0.24 | 0.04 |
| | | | Red light | 0.31 | 0.11 | 0.37 | 0.11 | 1.61 | 0.05 |
| 2 | Gelatin | 2.0 g | White light | 1.69 | 0.13 | 1.64 | 0.14 | 1.52 | 0.04 |
| | PVP | 5.0 g | Blue light | 1.65 | 0.14 | 0.25 | 0.15 | 0.14 | 0.03 |
| | Total | 7.0 g | Green light | 0.37 | 0.14 | 1.62 | 0.13 | 0.15 | 0.04 |
| | | | Red light | 0.36 | 0.13 | 0.24 | 0.12 | 1.59 | 0.05 |
| 3 | Gelatin | 4.0 g | White light | 1.55 | 0.14 | 1.50 | 0.13 | 1.42 | 0.10 |
| | PVP | 5.5 g | Blue light | 1.54 | 0.15 | 0.21 | 0.15 | 0.12 | 0.10 |
| | Total | 9.5 g | Green light | 0.20 | 0.16 | 1.48 | 0.14 | 0.18 | 0.11 |
| | | | Red light | 0.20 | 0.15 | 0.19 | 0.15 | 1.39 | 0.10 |
| 4 | Gelatin | 1.7 g | White light | 1.68 | 0.12 | 1.63 | 0.11 | 1.57 | 0.05 |
| | PVA | 3.5 g | Blue light | 1.66 | 0.11 | 0.22 | 0.10 | 0.11 | 0.02 |
| | Total | 5.2 g | Green light | 0.30 | 0.10 | 1.60 | 0.11 | 0.19 | 0.03 |
| | | | Red light | 0.21 | 0.11 | 0.27 | 0.09 | 1.50 | 0.04 |
| 5 | Gelatin | 5.1 g | White light | 1.52 | 0.07 | 1.28 | 0.08 | 1.13 | 0.01 |
| | PVP | 1.0 g | Blue light | 1.50 | 0.03 | 0.08 | 0.06 | 0.02 | 0.01 |
| | Total | 6.1 g | Green light | 0.14 | 0.04 | 1.25 | 0.08 | 0.02 | 0.01 |
| | | | Red light | 0.08 | 0.02 | 0.07 | 0.03 | 1.12 | 0.02 |
| 6 | Gelatin | 6.0 g | White light | 1.41 | 0.07 | 1.25 | 0.07 | 1.12 | 0.07 |
| | Total | 6.0 g | Blue light | 1.43 | 0.06 | 0.10 | 0.06 | 0.04 | 0.03 |
| | | | Green light | 0.13 | 0.04 | 1.27 | 0.07 | 0.03 | 0.02 |
| | | | Red light | 0.09 | 0.05 | 0.07 | 0.04 | 1.11 | 0.03 |
| 7 | Gelatin | 1.0 g | White light | 1.99 | 0.12 | 1.83 | 0.11 | 1.78 | 0.05 |
| | PVP | 1.9 g | Blue light | 1.25 | 0.10 | 0.67 | 0.11 | 0.38 | 0.04 |
| | Total | 2.9 g | Green light | 0.89 | 0.13 | 1.14 | 0.12 | 0.48 | 0.04 |
| | | | Red light | 0.57 | 0.12 | 0.64 | 0.11 | 1.17 | 0.04 |
| 8 | Gelatin | 3.4 g | White light | 1.57 | 0.34 | 1.31 | 0.37 | 1.25 | 0.47 |
| | PVP | 6.8 g | Blue light | 1.51 | 0.36 | 0.44 | 0.36 | 0.43 | 0.40 |
| | Total | 10.2 g | Green light | 0.37 | 0.33 | 1.28 | 0.37 | 0.44 | 0.41 |
| | | | Red light | 0.37 | 0.32 | 0.40 | 0.31 | 1.21 | 0.45 |

In the above table, "PVP" stands for polyvinyl pyrrolidone, while "PVA" stands for polyvinyl alcohol. And "Dmax" represents maximum density, while "Dmin" represents minimum density (fog density).

From the above results it is understood that each of the samples (Sample Nos. 1 to 6) for the present invention is capable of producing a transfer dye image having a small fog in the high density and excellent color separability, whereas the comparative sample (Sample No. 7) that contains a smaller amount of the binder than do the samples of the invention is inferior in the color separability, and the comparative sample (Sample No. 8) that contains an excessive amount of the binder has an increased fog and is inferior in the transferability of the dye from the bottom layer.

EXAMPLE 3

Samples were prepared in the same manner as in Example 1 except that the kind and amount of the heat solvent were changed as given in Table 3, and the prepared samples each was exposed and heat-developed in the same manner as in Example 1. The obtained results are shown in Table 3.

TABLE 3

| Sample No. | Heat solvent (amount) | | Exposed to | Blue light Measurement Dmax | Blue light Measurement Dmin | Green light Measurement Dmax | Green light Measurement Dmin | Red light Measurement Dmax | Red light Measurement Dmin |
|---|---|---|---|---|---|---|---|---|---|
| 9 | Petriol | 2.3 g | White light | 1.63 | 0.09 | 1.52 | 0.07 | 1.41 | 0.02 |
| | PEG(300) | 1.1 g | Blue light | 1.61 | 0.09 | 0.18 | 0.06 | 0.10 | 0.02 |
| | Total | 3.4 g | Green light | 0.26 | 0.07 | 1.49 | 0.06 | 0.13 | 0.03 |
| | | | Red light | 0.15 | 0.06 | 0.21 | 0.05 | 1.40 | 0.04 |
| 10 | 1,6-pentane- | 4.2 g | White light | 1.81 | 0.09 | 1.77 | 0.08 | 1.71 | 0.03 |
| | diol | | Blue light | 1.74 | 0.08 | 0.22 | 0.07 | 0.11 | 0.02 |
| | Total | 4.2 g | Green light | 0.29 | 0.09 | 1.71 | 0.07 | 0.19 | 0.03 |
| | | | Red light | 0.20 | 0.10 | 0.26 | 0.06 | 1.69 | 0.04 |
| 11 | Petriol | 2.8 g | White light | 1.77 | 0.13 | 1.72 | 0.14 | 1.63 | 0.11 |
| | 1,3-dimethyl- | 1.4 g | Blue light | 1.72 | 0.14 | 0.24 | 0.12 | 0.17 | 0.04 |
| | urea | | Green light | 0.35 | 0.11 | 1.69 | 0.14 | 0.22 | 0.06 |
| | Total | 4.2 g | Red light | 0.24 | 0.12 | 0.31 | 0.10 | 1.61 | 0.06 |
| 12 | Petriol | 2.8 g | White light | 1.87 | 0.19 | 1.82 | 0.18 | 1.77 | 0.15 |
| | 1,3-dimethyl- | 1.4 g | Blue light | 1.86 | 0.18 | 0.33 | 0.14 | 0.25 | 0.14 |
| | urea | | Green light | 0.39 | 0.13 | 1.79 | 0.17 | 0.29 | 0.13 |
| | PEG(300) | 1.4 g | Red light | 0.31 | 0.13 | 0.33 | 0.16 | 1.71 | 0.15 |
| | Total | 6.6 g | | | | | | | |

As is apparent from the above table, each of Samples 10 and 11, which contain heat solvents in the same amount as that used in the sample of Example 1, produces a transfer dye image having excellent heat-transferability, high maximum density with a small fog and satisfactory color-separability, whereas Sample 9, which contains a relatively small amount of heat solvents, produces an image inferior in the transfer density to the above Samples 10 and 11, and if the amount of the heat solvents is increased as in Sample 12, although the sample produces an image excellent in the transfer density, its fog also becomes increasing to some extent.

What is claimed is:

1. A multi-layer heat-development-type color light-sensitive material comprising a support having thereon a layer containing at least light-sensitive silver halide grains, an organic silver salt, a reducing agent, a yellow dye donator substance and a binder, a layer containing at least light-sensitive silver halide grains, an organic silver salt, a reducing agent, a magenta dye donator substance and a binder, and a layer containing at least light-sensitive silver halide grains, an organic silver salt, a reducing agent, a cyan dye donator substance and a binder, wherein said binder of said respective layers amounts in total to from 3 g to 10 g per $m^2$ of said support, and wherein at least one layer of said light-sensitive material contains from 10% to 300% by weight based on the quantity of the binder of a heat solvent.

2. The multi-layer heat-developement-type color light-sensitive material as claimed in claim 1, wherein said binders are hydrophilic.

3. The multi-layer heat-development-type color light-sensitive material as claimed in claim 1, wherein said binder is a mixture of gelatin and at least one kind of other hydrophilic binder (s) than the gelatin.

4. The multi-layer heat-development-type color light-sensitive material as claimed in claim 3, wherein said binder contains gelatin of not lss tnan 20% by weight.

5. Tne multi-layer heat-development-type color lignt-sensitive material as claimed in claim 4, wherein said binder contains gelatin of from 20% by weight to 80% by weight.

6. The multi-layer heat-development-type color light-sensitive material as claimed in claim 4, wherein said binder contains gelatin of from 20% by weight to 60% by weight.

7. The multi-layer heat-development-type color light-sensitive material as claimed in claim 2, wherein the total amount of gelatin out of said binder is from 0.6 grams to 5 grams per $m^2$ of a support.

8. The multi-layer heat-development-type color light-sensitive material as claimed in claim 3, wherein said hydrophilic binder(s) other tnan the gelatin is (are) at least one selected from the group of polyvinyl pyrrolidone and polyvinyl alconol.

9. The multi-layer heat-development-type color light-sensitive material as claimed in claim 1, wherein said heat solvent is at least one selected from tne group of a urea derivative, an amide derivative. a polyethylene glycol and a polyhydric alcohol.

* * * * *